US007731324B2

(12) United States Patent
Nagashima

(10) Patent No.: US 7,731,324 B2
(45) Date of Patent: Jun. 8, 2010

(54) INKJET RECORDING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 115 days.

(21) Appl. No.: 11/966,903

(22) Filed: Dec. 28, 2007

(65) Prior Publication Data

US 2008/0211853 A1 Sep. 4, 2008

Related U.S. Application Data

(62) Division of application No. 11/044,087, filed on Jan. 28, 2005, now Pat. No. 7,607,773.

(30) Foreign Application Priority Data

Jan. 30, 2004 (JP) ..... 2004-023671

(51) Int. Cl.
*B41J 29/393* (2006.01)
*B41J 2/01* (2006.01)
*B41J 29/38* (2006.01)

(52) U.S. Cl. ..... 347/19; 347/102; 347/14

(58) Field of Classification Search ..... 347/102, 347/101, 5, 9, 19, 14; 101/488; 219/216; 346/25; 399/320
See application file for complete search history.

(56) References Cited

U.S. PATENT DOCUMENTS 6,092,890 A 7/2000 Wen et al.
6,145,979 A 11/2000 Caiger et al.
6,562,413 B1 5/2003 Morgavi
6,786,589 B2 9/2004 Suzuki et al.
6,790,875 B2 9/2004 Noguchi et al.
7,014,310 B2 3/2006 Hirai
7,055,925 B2 * 6/2006 Subirada et al. ..... 347/19
7,097,297 B2 8/2006 Hasabe et al.
7,453,609 B2 * 11/2008 Itagaki ..... 358/518
2002/0140794 A1 10/2002 Asano et al.
2003/0011670 A1 1/2003 Shirakawa
2003/0184631 A1 10/2003 Suzuki et al.
2003/0222961 A1 12/2003 Nakajima
2004/0189771 A1 9/2004 Hasebe et al.
2005/0093952 A1 5/2005 Hoshino
2007/0132801 A1 * 6/2007 Reichelsheimer et al. ..... 347/19

FOREIGN PATENT DOCUMENTS

JP 60-132767 A 7/1985

(Continued)

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The inkjet recording apparatus includes: a head which ejects ink droplets of light-curable ink to a print medium to form an image on the print medium; a light irradiating device which is located at a downstream side of the head, and irradiates light from a light source onto the ink droplets immediately after the ink droplets have been deposited on the print medium; and a control device which controls the light irradiating device in such a manner that luminous energy irradiated onto a region of the print medium where bleeding of the ink droplets would be conspicuous is greater than luminous energy irradiated onto another region of the print medium.

11 Claims, 12 Drawing Sheets

FOREIGN PATENT DOCUMENTS

| | | | |
|---|---|---|---|
| JP | 8-216393 | A | 8/1996 |
| JP | 2002-187918 | A | 7/2002 |
| JP | 2003-11334 | A | 1/2003 |
| JP | 2003-11343 | A | 1/2003 |
| JP | 2003-89198 | A | 3/2003 |
| JP | 2003-145725 | A | 5/2003 |
| JP | 2003-145741 | A | 5/2003 |
| JP | 2003-191594 | A | 7/2003 |
| JP | 2003-192943 | A | 7/2003 |
| JP | 2003-326691 | A | 11/2003 |

* cited by examiner

FIG.12A

PREWITT MATRIX

| | | |
|---|---|---|
| 1 | 0 | -1 |
| 1 | 0 | -1 |
| 1 | 0 | -1 |

FIG.12B

SOBEL MATRIX

| | | |
|---|---|---|
| 1 | 0 | -1 |
| 2 | 0 | -2 |
| 1 | 0 | -1 |

FIG.12C

ROBERTS MATRIX

| | | |
|---|---|---|
| 0 | 0 | -1 |
| 0 | 1 | 0 |
| 0 | 0 | 0 |

INKJET RECORDING APPARATUS

CROSS-REFERENCE TO RELATED APPLICATION

This is a divisional application of application Ser. No. 11/044,087, filed Jan. 28, 2005, now U.S. Pat. No. 7,607,773 which is a non-provisional application that claims priority under 35 U.S.C. §119(a) on Patent Application No. 2004-023671 filed in Japan on Jan. 30, 2004, the entire contents of which are hereby incorporated by reference.

BACKGROUND OF THE INVENTION

1. Field of the Invention

The present invention relates to an inkjet recording apparatus, and more particularly to a technology for preventing ink from bleeding.

2. Description of the Related Art

Conventional printing processes are well known in which printing is carried out onto a print medium by employing an ultraviolet (UV) curable ink, and the ink is prevented from bleeding by causing the ink to harden by irradiating UV light onto the ink after the ink has been deposited on the print medium.

Japanese Patent Application Publication No. 2003-11334 discloses a device in that a UV light source is arranged integrally with an ink ejecting head along the travel direction of the head. The ink ejected from the head is caused to harden by irradiating UV light from the UV light source onto the ink in a recorded region that has been recorded in the previous scan.

Japanese Patent Application Publication No. 2003-11343 discloses a technique in that, when an ink ejection operation has been performed, the ejected ink is hardened by irradiating UV light before the next ink ejection operation in order to prevent ink bleeding and recording irregularities.

In Japanese Patent Application Publication No. 2002-187918, paragraph "0104", there is a description that the ink should be caused to harden before the ink permeates into the recording medium (the recording paper).

Japanese Patent Application Publication No. 2003-89198 discloses that a light guide that irradiates setting light for provisional curing is arranged in the vicinity of an inkjet nozzle. After the ink has been provisionally cured by means of the setting light from the light guide, the ink is durably fixed by another light source.

Japanese Patent Application Publication No. 2003-145741 discloses a fixed UV light source of a size that can cover the range scanned by a head.

In Japanese Patent Application Publication No. 2003-192943, there is a description that a time period from the ink ejection to the UV irradiation is determined. Japanese Patent Application Publication No. 2003-192943 also discloses a line type head having a length corresponding to the maximum width of the print medium.

In Japanese Patent Application Publication No. 2003-191594, there is a description that various irradiation conditions, such as the light irradiation time, irradiation intensity, irradiation surface area, and angle of incidence, are adjusted in accordance with the type of the print medium, the type of the ink, the viscosity of the ink, and the like.

Japanese Patent Application Publication No. 60-132767 and U.S. Pat. No. 6,092,890 disclose a UV light source arranged integrally with a head.

U.S. Pat. No. 6,145,979 discloses a device in that light is guided from the outside of a head to the vicinity of the head through mirrors or an optical fiber, and the device irradiates the light with the movement of the head unit.

The above-described conventional apparatuses are classified into any one of the followings:

(1) a light source for curing ink is fixed to an inkjet recording apparatus, and the light source irradiates light onto the whole of the irradiation object as the irradiation object moves;

(2) a light source for curing ink is fixed to a head, and the light source irradiates light onto the irradiation object as the head moves for scan; or (3) a light source for curing ink guides light to the head from the outside of the head through some kind of device and/or method, and the light source irradiates light onto the irradiation object as the head moves for scan.

All of the above-described conventional apparatuses adopt the same approach in that the light is directed onto the whole of the print medium. The conventional apparatuses are devised in order that the light is irradiated as immediately as possible after printing so that the print ink can be prevented from bleeding. More specifically, the above-described conventional inkjet recording apparatuses irradiate UV light immediately after the ink has been ejected toward the print medium so that the ink is prevented from bleeding; however, they may involve the following problems.

(1) In order to irradiate the UV light immediately after the ink has been ejected, it is necessary to arrange a light source or a member for guiding the UV light in the vicinity of the head. When the UV light is to be irradiated onto the entire print region for causing the ink to harden, high energy is required and hence the light source unit can be large in size.

(2) When the UV light is irradiated onto the print medium, the UV light can reach the peripheral areas by the diffuse reflection at the irradiation position. If the irradiation position of the UV light is brought close to the print position so that the ink can be prevented from bleeding, the diffuse reflected UV light may cause the ink to harden inside the head before the ink is ejected. Thus, there is a possibility of head blockages.

(3) If a laser diode having good light emission efficiency is used in order to save energy in the inkjet recording apparatus, there is a possibility that the energy may not be sufficient to cause the ink to harden over the whole print medium depending on the speed of conveyance of the print medium, since the luminous energy emitted from the laser diode may be smaller than that from other devices, such as an electric discharge tube.

SUMMARY OF THE INVENTION

The present invention has been made in view of foregoing circumstances, and it is an object of the invention to provide an inkjet recording apparatus that can effectively prevent the ink from bleeding with a small total luminous energy, accordingly the light source unit can be compact and the head blockages can be prevented. Furthermore, it is another object of the invention to provide an inkjet recording apparatus that can determine the ink which is ejected from the head by the same optical system as that used to harden the ink.

In order to attain the aforementioned object, the present invention is directed to an inkjet recording apparatus, comprising: a head which ejects ink droplets of light-curable ink to a print medium to form an image on the print medium; a light irradiating device which is located at a downstream side of the head, and irradiates light from a light source onto the ink droplets immediately after the ink droplets have been deposited on the print medium; and a control device which controls the light irradiating device in such a manner that luminous energy irradiated onto a region of the print medium where bleeding of the ink droplets would be conspicuous is greater than luminous energy irradiated onto another region of the print medium.

According to the present invention, as the light is intensively irradiated onto the region where the bleeding of the ink would be conspicuous, it is possible to effectively prevent the bleeding of the ink and to reduce the total luminous energy irradiated onto the print medium.

Preferably, the region of the print medium where the bleeding of the ink droplets would be conspicuous is at least one of an edge of a solid print region in the image, an edge of a line region in the image, an isolated dot in the image, a region of high contrast in the image, and a region of large color variation in the image.

Preferably, the light irradiating device includes a scanning device which scans the print medium in a width direction of the print medium with the light having a prescribed beam width; and the control device controls the light irradiating device to irradiate constant luminous energy, and controls the scanning device in such a manner that a scanning speed with respect to the region of the print medium where the bleeding of the ink would be conspicuous is slower than a scanning speed with respect to the other region of the print medium.

According to the present invention, the light irradiating device has the scanning device which scans the print medium in the width direction of the print medium with the light of the prescribed beam width. Rather than adopting a constant scanning speed in the scanning device, the scanning speed is slowed with respect to the region where the bleeding of the ink would be conspicuous and the scanning speed is raised in the other regions. Thereby, the light is intensively irradiated onto the region where the bleeding of the ink would be conspicuous.

Alternatively, it is also preferable that the light irradiating device includes a scanning device which two-dimensionally scans the print medium in a width direction and a conveyance direction of the print medium with the light having a prescribed beam width; and the control device controls the light irradiating device to irradiate constant luminous energy, and controls the scanning device in such a manner that a scanning speed with respect to the region of the print medium where the bleeding of the ink would be conspicuous is slower than a scanning speed with respect to the other region of the print medium.

Alternatively, it is also preferable that the light irradiating device includes a scanning device which two-dimensionally scans the print medium in a width direction and a conveyance direction of the print medium with the light having a prescribed beam width; and the control device controls the light irradiating device to irradiate constant luminous energy, and controls the scanning device in such a manner that the region of the print medium where the bleeding of the ink would be conspicuous is scanned a plurality of times.

If the region where the bleeding of the ink would be conspicuous extends in the width direction of the print medium, then a long time is required to perform one scan if the scanning speed is slowed in this region. Hence, there is a possibility that irradiation misses may occur depending on the size of the beam and the speed of the conveyance of the print medium. According to the present invention, rather than reducing the scanning speed significantly, the same location is scanned a plurality of times while altering the orientation of the beam at each scan. Thereby, the light is intensively irradiated onto the region where the bleeding of the ink would be conspicuous.

Alternatively, it is also preferable that the light irradiating device includes a scanning device which two-dimensionally scans the print medium in a width direction and a conveyance direction of the print medium with the light having a prescribed beam width; and the control device controls a scanning speed of the scanning device to be constant, and controls the light source of the light irradiating device in such a manner that the luminous energy irradiated onto the region of the print medium where the bleeding of the ink would be conspicuous is increased.

According to the present invention, the light scanning speed of the scanning device is set to the constant speed, and the luminous energy emitted from the light source is adjusted (more specifically, the luminous energy is changed so that the irradiated luminous energy can be greater at the region where the bleeding of the ink would be conspicuous).

Preferably, the light irradiating device includes a scanning device, including: the light source which emits the light; an optical system including a scanning mirror, the optical system concentrating the light emitted by the light source onto the print medium through the scanning mirror; and a mirror turning device which turns the scanning mirror.

For example, the head is a line type head having a length corresponding to a maximum width of the print medium; and the light irradiating device comprises a plurality of the scanning devices arranged in a longitudinal direction of the line type head. The number of the scanning devices is set according to the width that can be scanned by each of the scanning devices and the length of the line type head.

Preferably, the inkjet recording apparatus further comprises a print determination device, including: a branching device which is disposed in an optical path between the light source and the scanning mirror, and causes reflected light which is reflected at a focal point of the optical system on the print medium and returns back through the optical system to branch off, an optical sensor which measures the reflected light branched off by the branching device and outputs a measurement signal; and a judging device which judges whether the ink droplet presents on the print medium or not according to the measurement signal obtained from the optical sensor.

According to the present invention, the optical system of the light irradiating device is utilized to branch off the light irradiated toward and reflected by the ink droplets so as to direct the reflected light to the optical sensor. It is then judged whether the ink droplets have been deposited or not according to the measurement signal outputted from the optical sensor. The reflected light includes the light based on mirror reflection and the light based on diffuse reflection.

Alternatively, it is also preferable that the inkjet recording apparatus further comprises an ink ejection determination device, including: a first branching device which is disposed in an optical path of the optical system, and causes the light to branch off in such a manner that the light passes through a gap between the head and the print medium, thereby irradiating the light onto the ink droplets which have been ejected from the head and have not yet been deposited on the print medium; a second branching device which is disposed in the optical path between the light source and the scanning mirror, and causes reflected light reflected by the ink droplets which have not yet been deposited on the print medium and returned back through the optical system to branch off; an optical sensor which measures the reflected light branched off by the second branching device and outputs a measurement signal; and a judging device which judges whether the ink droplets have been ejected from nozzles of the head or not according to the measurement signal obtained from the optical sensor.

According to the present invention, utilizing the optical system of the light irradiating device, the light is branched off by means of the first branching device situated in the optical path of the optical system, in such a manner that the light passes through the gap between the head and the print medium and is directed onto the ink droplets that have been ejected from the head and have not yet been deposited on the print medium. The light irradiated toward and reflected by the ink droplets returns through the same optical system, is branched by the second branching device, and is directed to the optical sensor. It is then judged whether the ink droplets have been ejected from the nozzles of the head or not according to the measurement signal outputted from the optical sensor.

According to the present invention, it is possible to reduce the total luminous energy irradiated onto the print medium and effectively prevent the bleeding of the ink, since the light is intensively irradiated onto the region where the bleeding of the ink would be conspicuous, such as the edges of the solid print region, the edges of the line region, the isolated dots, the regions of high contrast, and the regions of large color variation. Furthermore, it is possible that the light source unit can be more compact and the head blockages can be prevented by restricting the total luminous energy.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 12A, 12B, and 12C are diagrams showing the Prewitt matrix, the Sobel matrix and the Roberts matrix for edge detection.

DETAILED DESCRIPTION OF THE PREFERRED EMBODIMENTS

Figure 1:
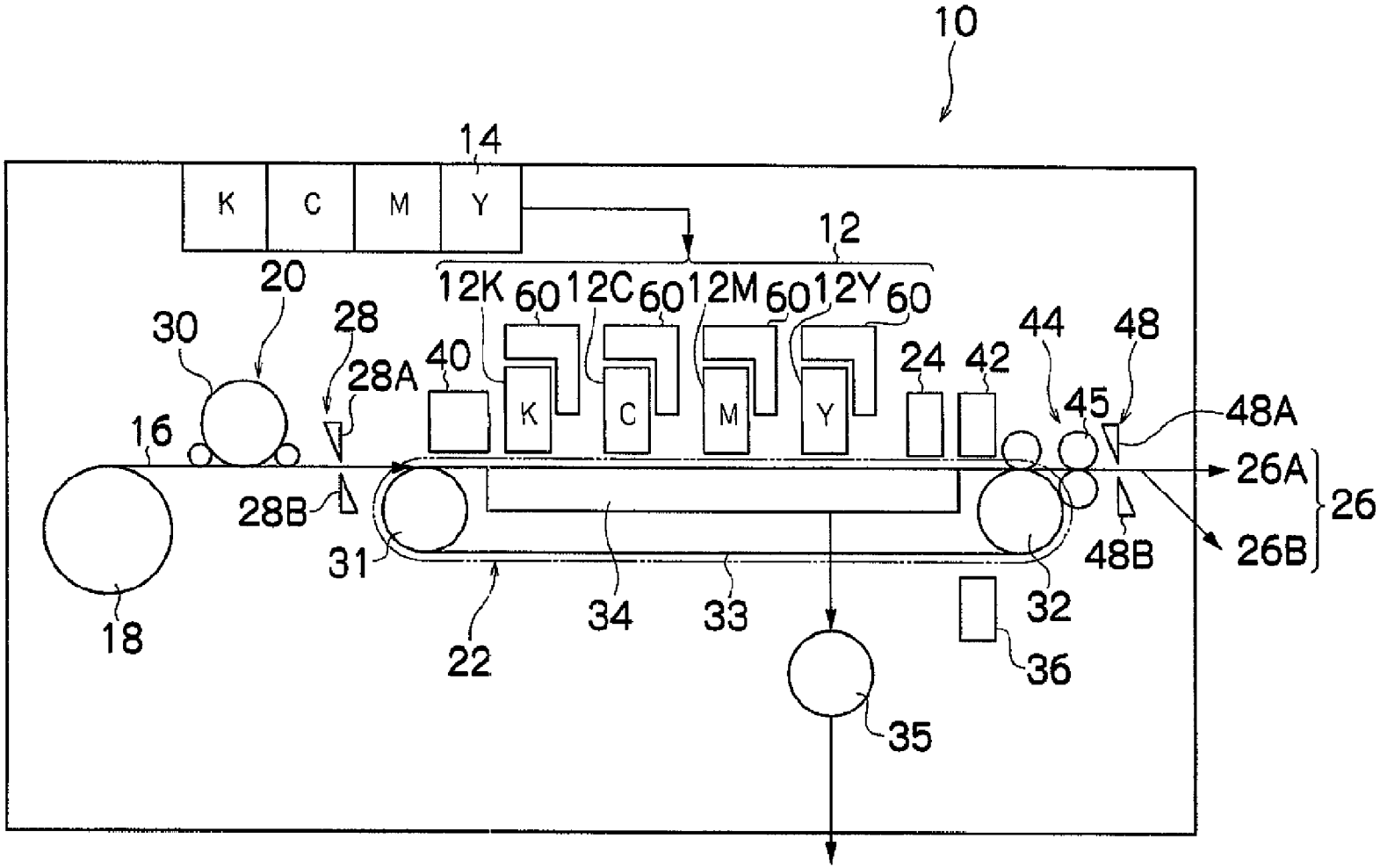
FIG. 1 is a general schematic drawing of an inkjet recording apparatus according to an embodiment of the present invention.

First) the description of an inkjet recording apparatus according to the present invention is explained. FIG. 1 is a general schematic drawing of an inkjet recording apparatus for forming an image by ejecting inks as droplet onto a recording medium, according to an embodiment of the present invention. As shown in FIG. 1, the inkjet recording apparatus 10 comprises: a printing unit 12 having a plurality of inkjet heads (hereinafter referred to as "head" simply) 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16, which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side along the delivering direction of the recording paper (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

The print determination unit 24 has a line sensor for capturing an image of the ink-droplet deposition result of the print unit 12, and functions as a device to check for ejection defects such as clogs of the nozzles in the print unit 12 from the ink-droplet deposition results evaluated by the line sensor.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cuffing the test print portion from the target print portion when a test print has been performed in the blank portion of the target print. The structure of the cutter 48 is the same as the first cutter 28 described above, and has a stationary blade 48A and a round blade 48B.

Figure 2:
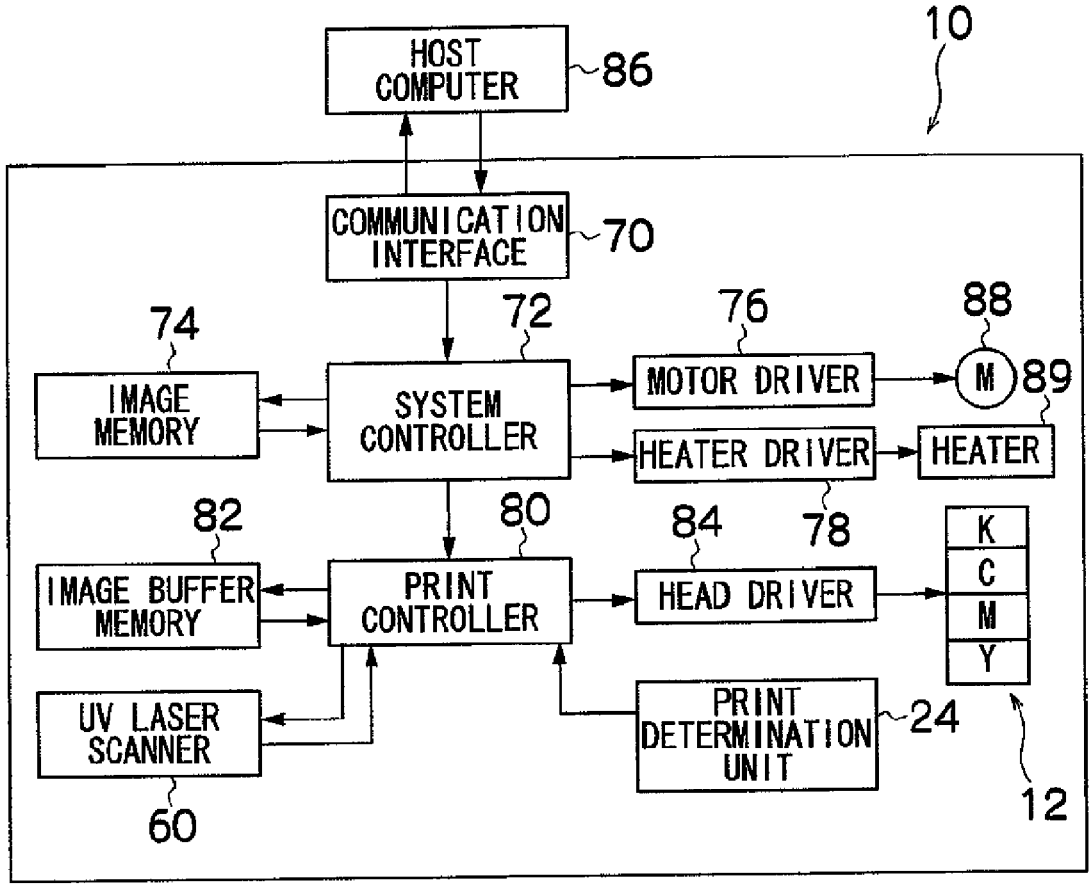
FIG. 2 is a block diagram of principal components showing the system composition of the inkjet recording apparatus.

FIG. 2 is a principal block diagram showing the system configuration of the inkjet recording apparatus 10.

The inkjet recording apparatus 10 has a UV laser scanner 60, a communication interface 70, a system controller 72, an image memory 74, a motor driver 76, a heater driver 78, a print controller 80, an image buffer memory 82, a head driver 84, and other components.

The UV laser scanner 60 makes UV curable inks harden by irradiating UV light to the ink droplets deposited on the recording paper 16 for preventing the ink from bleeding. A specific structural example of the UV laser scanner 60 is described later.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefore, and the like. The system controller 72 controls communication between itself and the host computer 86, controls reading and writing from and to the image memory 74, and performs other functions, and also generates control signals for controlling the motor 88 and a heater 89 in the conveyance system.

The motor driver (the drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84. Prescribed signal processing is carried out in the print control unit 80, and the ejection amount and the ejection timing of the ink droplets or the protective liquid from the respective print heads are controlled via the head driver 84, on the basis of the image data. By this means, prescribed dot size, dot positions, or coating of protective liquid can be achieved.

As described later, the print controller 80 has functions for controlling the UV laser scanner 60 to prevent the ink bleeding, and for determining the printing and the ink ejection according to determination signals inputted from the UV laser scanner 60.

The print controller 80 is provided with the image buffer memory 82; and image data, parameters, and other data are temporarily stored in the image buffer memory 82 when image data is processed in the print controller 80. The aspect shown in FIG. 2 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 59 for the print heads 12K, 12C, 12M and 12Y of the respective colors on the basis of the print data received from the print controller 80. A feedback control system for keeping the drive conditions for the print heads constant may be included in the head driver 84.

As shown in FIG. 1, the print determination unit 24 is a block including the line sensor. The print determination unit 24 scans the image printed on the recording paper 16, performs various signal processing operations and the like, and determines the print situation (e.g., whether the ink has been ejected or not, variation in the ink droplet ejection, etc.). Then, the print determination unit 24 supplies these determination results to the print control unit 80. Furthermore, as circumstances demand, the print controller 80 makes various corrections with respect to the print unit 12 according to information obtained from the print determination unit 24.

Next, the UV laser scanner 60 is described.

The inks of various colors, namely black (K), cyan (C), magenta (M) and yellow (Y) in the ink storing and loading unit 14 are UV curable inks, which are hardened when exposed to UV light. Each of the heads 12K, 12C, 12M, 12Y, which ejects the ink of a particular color, is provided with a UV laser scanner 60.

Figure 3:
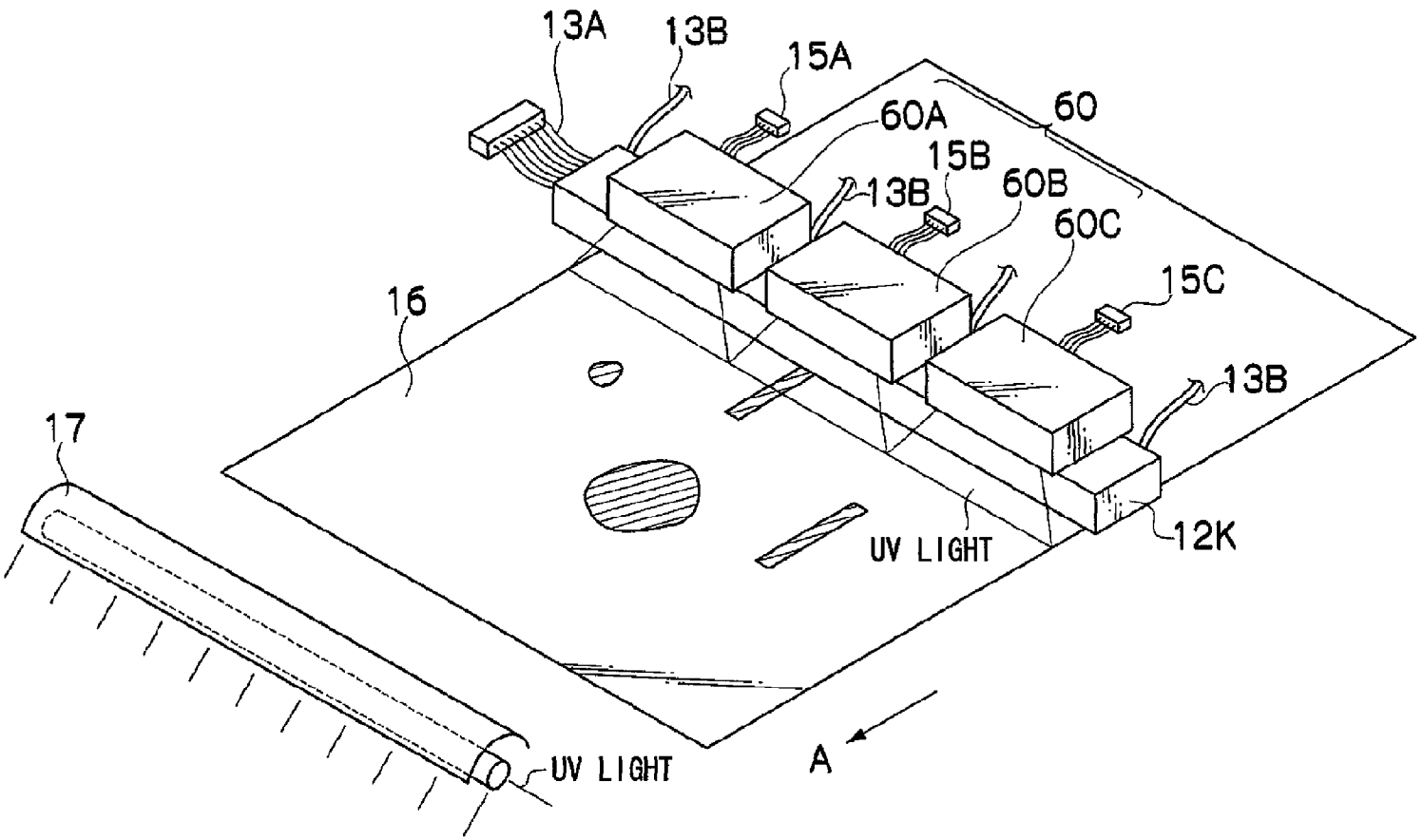
FIG. 3 is a perspective view of a print unit having an integrally installed UV laser scanner.

FIG. 3 is a perspective diagram of the head 12K and the UV laser scanner 60, which is integrally arranged on the head 12K.

As shown in FIG. 3, the UV laser scanner 60 comprises three scanners 60A, 60B and 60C. The number of scanners, constituting the UV laser scanner 60 corresponding to each head, is not limited to three, and may be set in accordance with the width of the head and the width of the scan performed by one scanner.

The recording paper (the printing paper) 16 is a paper of the maximum width that can be printed by using the head 12. The UV laser scanner 60 is able to scan the entire width of the recording paper 16 by means of UV light.

The head 12K is connected to a flexible wiring board 13A for driving and controlling each of actuators on nozzles in the head 12K. The head 12K is also connected to pipes 13B for supplying black (K) ink to the head 12K. The scanners 60A, 60B and 60C are connected to flexible wiring boards 15A, 151B and 15C, through which signals for controlling the operation of the scanners 60A, 60B and 60C are applied to the respective scanners, and determination signals from optical sensors (described hereafter) in the scanners 60A, 60B and 60C are outputted. A UV lamp 17 is fixed to a prescribed position corresponding to the downstream side of the recording paper 16 fed in the direction of arrow A, and is capable of simultaneously irradiating the UV light across the entire width of the recording paper 16.

Figure 4:
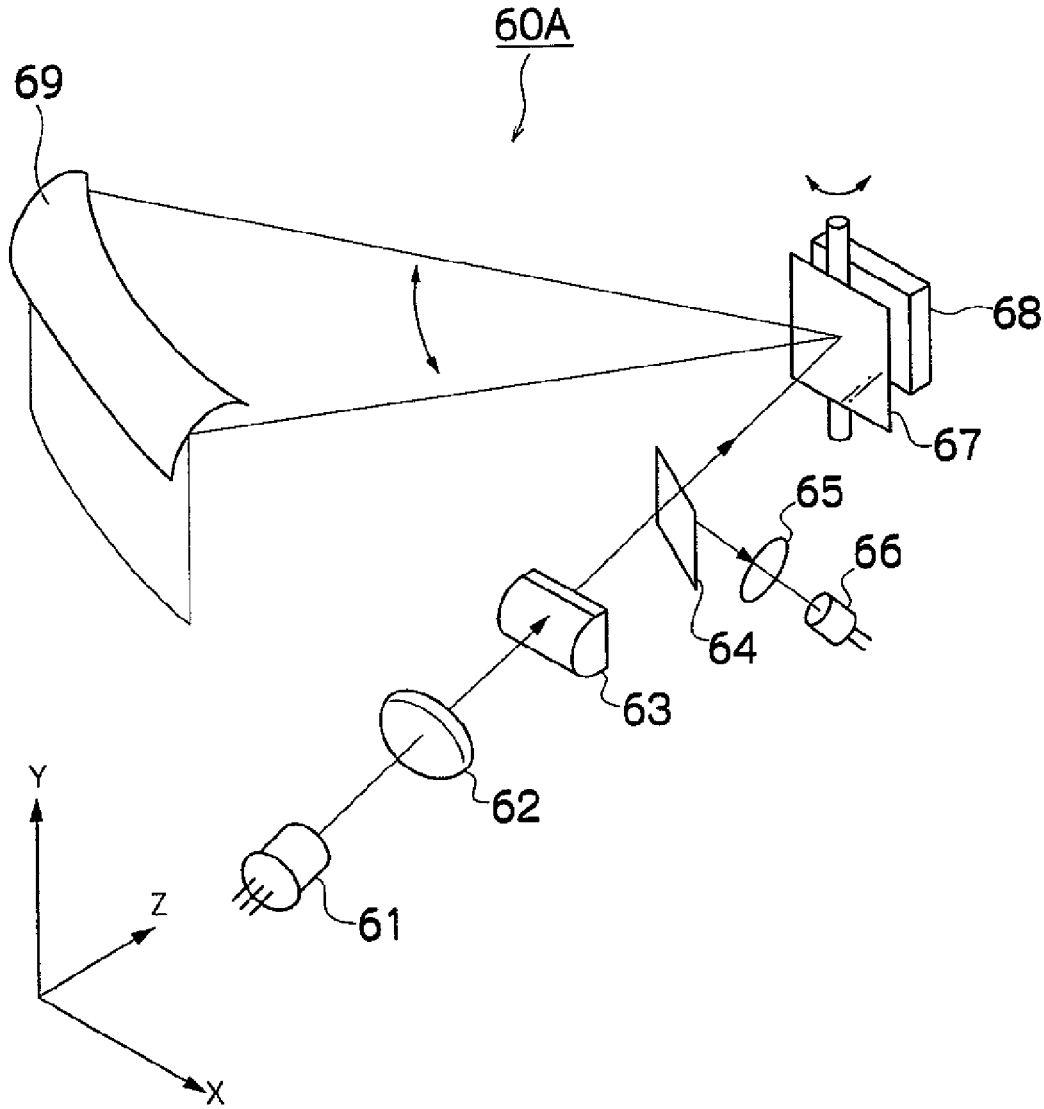
FIG. 4 is a diagram showing the internal composition of the UV laser scanner.

FIG. 4 is a diagram showing the internal composition of the scanners 60A, 60B, and 60C of the UV laser scanner 60, the diagram being relevant to the scanner 60A as an example.

As shown in FIG. 4, the scanner 60A principally comprises a UV laser light source (e.g., a UV laser diode) 61, a collimator lens 62, a cylindrical lens 63, a scanning mirror 67, and a condenser mirror 69. The scanner 60A further comprises: a semitransparent mirror (or a polarization mirror) 64 arranged in the light path between the cylindrical lens 63 and the scanning mirror 67; a condenser lens 65 for concentrating the light branched off by the semitransparent mirror 64; and an optical sensor 66, such as a photodiode, for determining the light concentrated by the condenser lens 65.

Figure 5A:
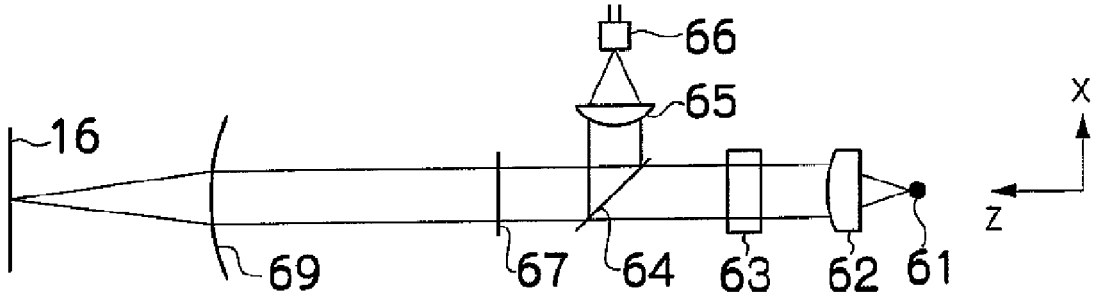
FIGS. 5A and 5B are schematic drawings of the optical system of the UV laser scanner.
Figure 5B:
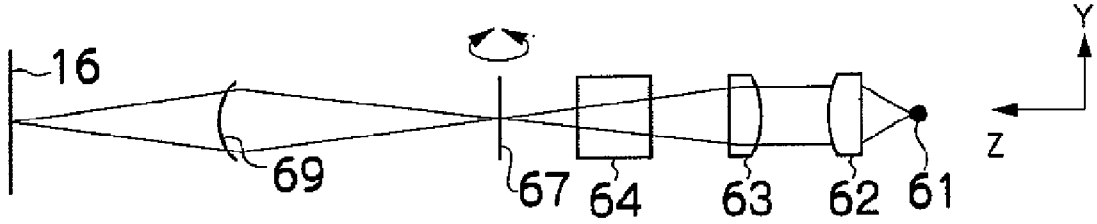

FIGS. 5A and 5B are schematic drawings of the optical system of the scanner 60A in the xz plane and the yz plane, respectively. As shown in FIG. 4, the x direction is the longitudinal direction of the head 12K, which is the scanning direction of the UV light. The z direction is the direction of the optical axis of the optical system of the scanner 60A. The y direction is the direction orthogonal to both the x and z directions.

UV light emitted from the UV laser light source 61 is converted into parallel light by the collimator lens 62, and then enters the cylindrical lens 63. The parallel light incident on the cylindrical lens 63 is concentrated in the y direction by the cylindrical lens 63, and then enters the semitransparent mirror 64, the scanning mirror 67, and the condenser mirror 69. The UV laser light incident on the condenser mirror 69 is concentrated in the x and y directions by the condenser mirror 69. The UV light emitted from the UV laser light source 61 is concentrated into the UV light of a prescribed size on the recording paper 16 through this optical system. In the optical system of the scanner 60A, the light emission point of the UV laser light source 61 is conjugate with the light concentrating point on the recording paper 16.

The size of the UV light concentrated on the recording paper 16 is required to be larger than the print size of one dot of the ink (for example, 25 μm in diameter). The exact size to which the UV light concentrated on the recording paper 16 is preferably set varies depending on the characteristics of the ink and the print medium. In the case of the combination of the ink and the print medium that is highly prone to lead to the bleeding of the ink, it is desirable that UV light be irradiated over the broader width on the recording paper 16. In the case of the combination of a standard paper and a standard ink property, it is desirable that the irradiated UV light has a width of approximately 0.1 mm to 0.5 mm on the recording paper 16. The condenser mirror 69 may or may not have the fθ characteristics and the sine characteristics, and the scanning line may or may not be linear.

The scanning mirror 67 is arranged turnably on an axis in the y direction as shown in FIG. 4. The scanning mirror 67 is turned to a desired angle by means of a mirror driver 68, which is driven by electrostatic force, electromagnetic force, or the like. By controlling the angle of the scanning mirror 67 according to a command from the print controller 80, the UV light concentrated on the recording paper 16 can be irradiated to scan in the x direction, which is the width direction of the recording paper 16. In this case, since the UV laser scanner 60 is not used to actually record images, it is not necessary to perform the scanning in high accuracy (high accuracy of position) as in the case of a general laser printer. A suitable scanning accuracy may be set in accordance with the size of the irradiated UV light, the conveyed speed of the print medium, and the amount of movement of the print medium determined from the time required to perform one scan so that the irradiation miss concerning the ink droplets that require irradiation does not arise.

Next, a method of preventing bleeding of ink according to the present embodiment of the present invention is described.

Figure 6:
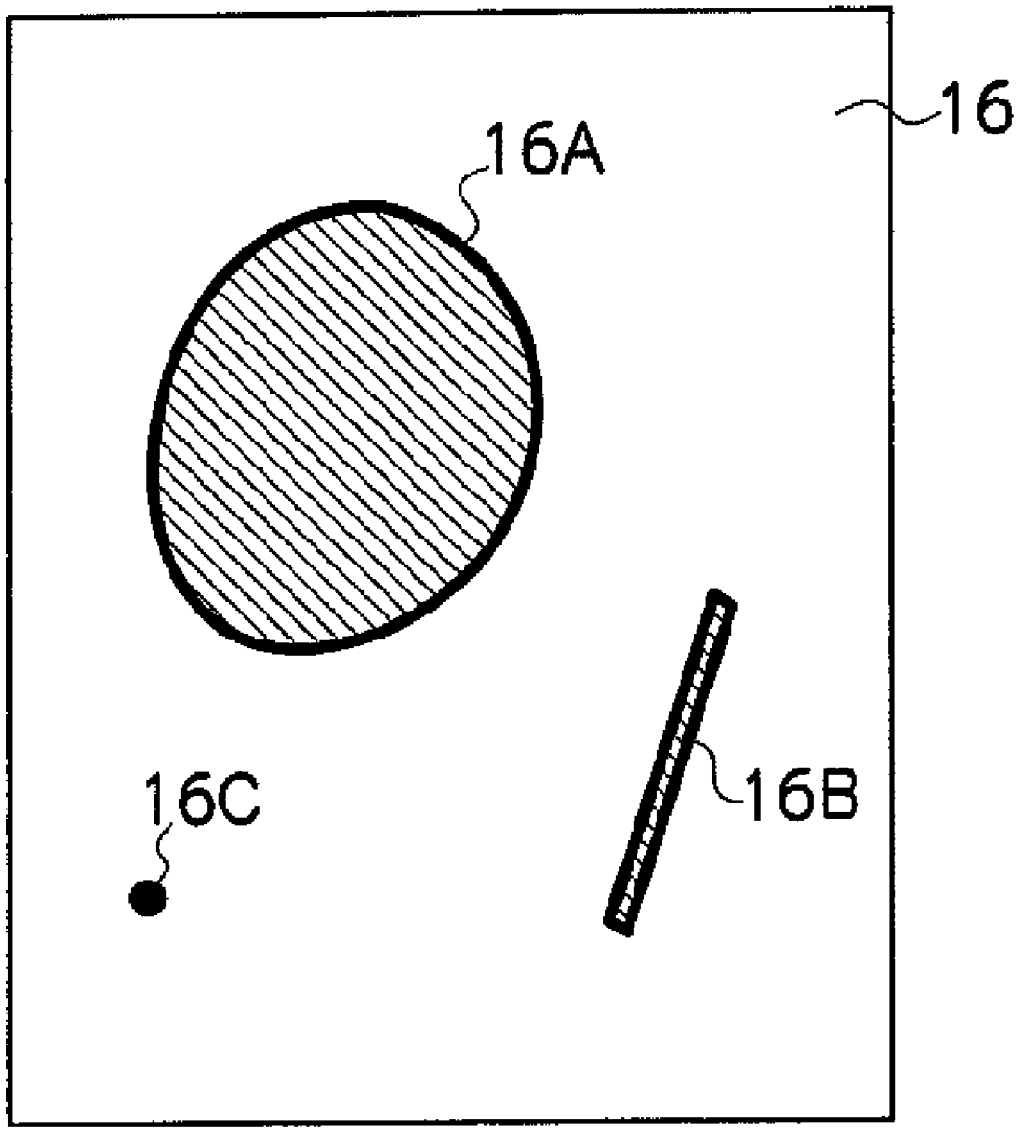
FIG. 6 is a diagram for describing a UV light irradiating unit in the UV laser scanner.

FIG. 6 shows a recording paper 16 after irradiation with the UV light by the UV laser scanner 60. The thick lines in FIG. 6 represent regions irradiated with the UV light by the UV laser scanner 60.

In the present embodiment, immediately after printing, the UV light is concentrated and irradiated by the UV laser scanner 60 onto regions where bleeding of ink would be conspicuous, such as edges of a solid print region 16A, edges of a line region 16B, and an isolated dot 16C on the recording paper 16. After that, the UV lamp 17 is used for irradiating the UV light onto the whole region of the recording paper 16 so that the ink can be hardened, as shown in FIG. 3.

Next, a method for irradiating the UV light intensively onto the regions of the recording paper 16 where the bleeding of the ink would be conspicuous is described.

Figure 7A:
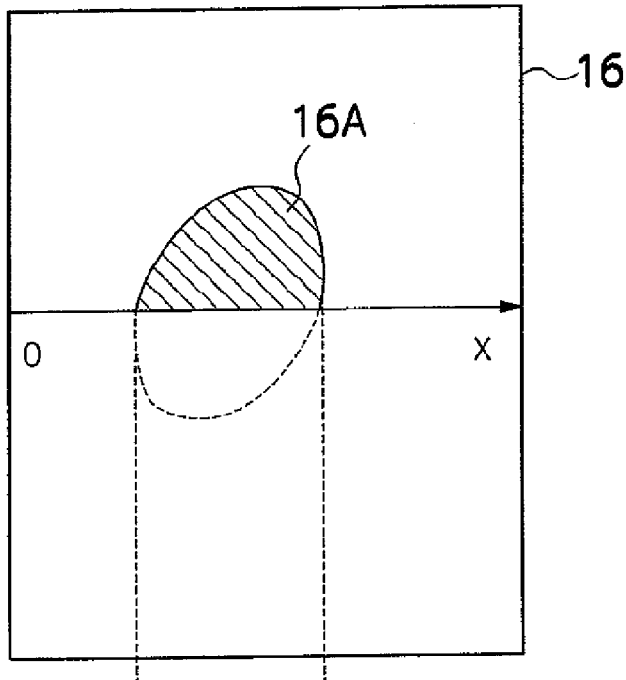
FIGS. 7A, 7B, and 7C are diagrams for describing a method for irradiating UV light intensively onto the region of the recording paper where the bleeding of the ink would be conspicuous.
Figure 7B:
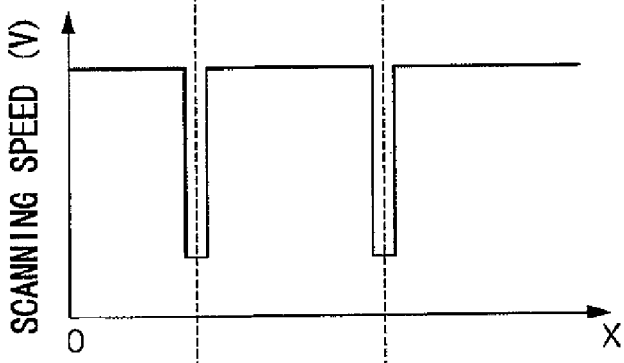

As shown in FIG. 7A, when the UV light is intensively irradiated onto the edges of the solid print region 16A by the UV laser scanner 60 while the solid print region 16A is being printed, the scanning speed of the UV light in the x direction, which is the width direction of the recording paper 16, is varied depending on the scanning position as shown in FIG. 7B so as to be adjusted to a low speed only when the UV light is being irradiated onto the edges of the solid print region 16A. In this case, the luminous energy of the UV light emitted from the UV laser light source 61 is constant.

Figure 7C:
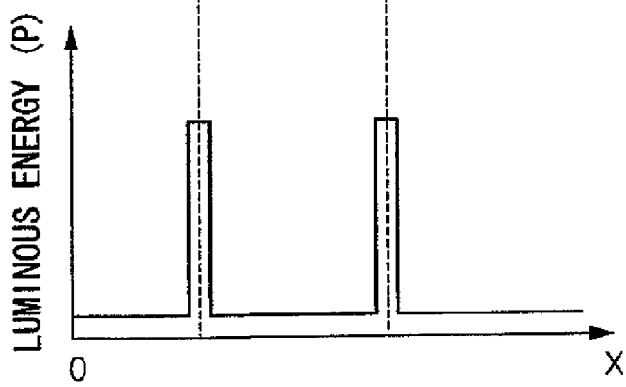

On the other hand, it is possible that the scanning speed of the UV laser scanner 60 is constant, and that the luminous energy of the UV light emitted from the UV laser light source 61 is changeable as shown in FIG. 7C. The luminous energy is adjusted to a maximum when the UV light is being irradiated onto the edges of the solid print region 16A, whereas the luminous energy is reduced to the luminous energy of a bias level when the UV light is being irradiated onto other regions of the recording paper 16. The luminous energy is reduced to a bias level in FIG. 7C with respect to the regions other than the border regions, whereas the UV laser light source 61 can be turned off with respect to the regions other than the border regions.

The scanner 60A shown in FIG. 4 performs one-dimensional scanning with the UV light. It is also possible to adopt a configuration in which the scanning mirror 67 is also tunable on an axis in the x direction so that the scanner 60A can perform two-dimensional scanning.

Next, a method for scanning with the UV light by means of a scanner capable of two-dimensional scanning is described.

In FIG. 5A, print regions 16D and 16E printed on the recording paper 16 have long edges in the direction orthogonal to the x direction, and a print region 16F has a long edge in the x direction.

Figure 8A:
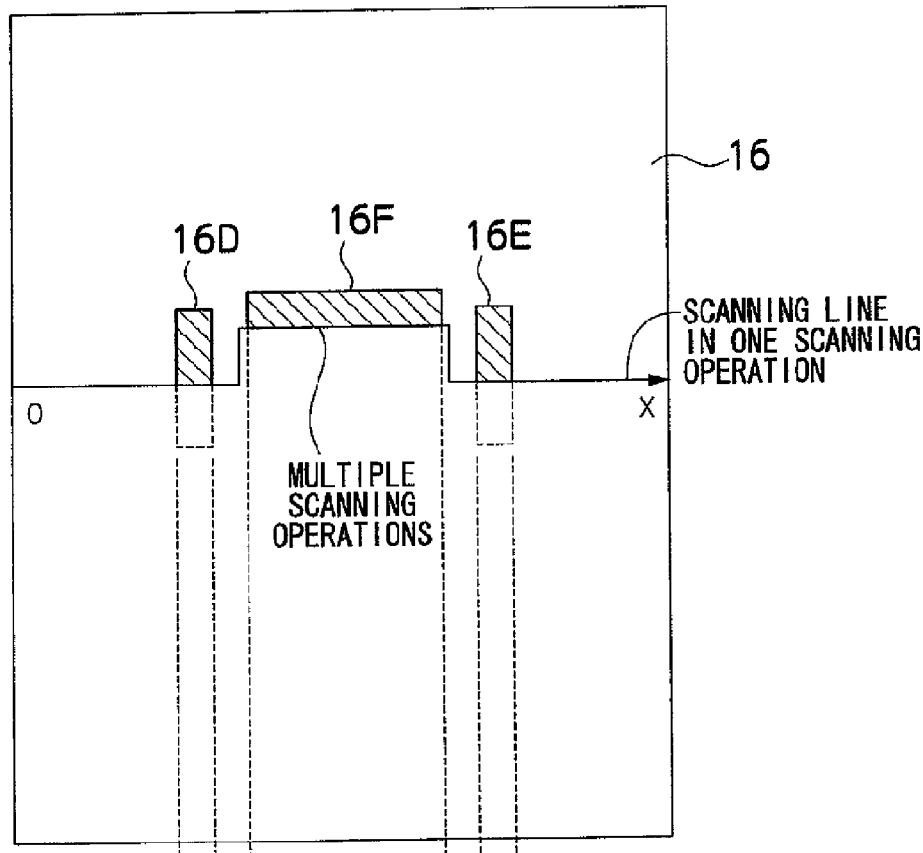
FIGS. 8A and 8B are diagrams for describing a further method for irradiating UV light intensively onto the region of the recording paper where the bleeding of the ink would be conspicuous.
Figure 8B:
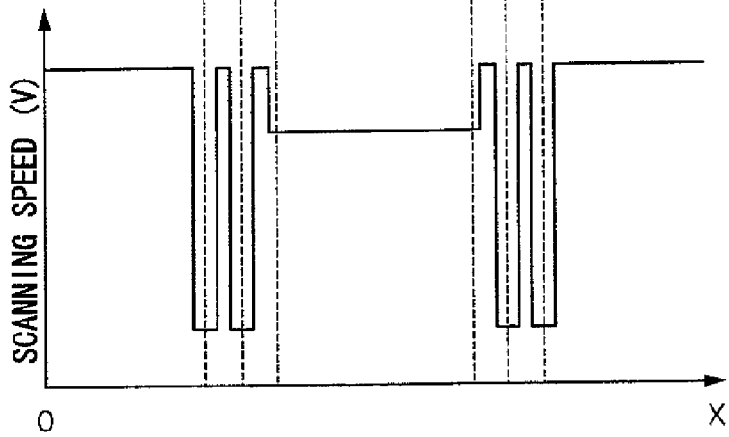

If the UV light is intensively irradiated onto the edges of the print regions 16D, 16E and 16F, then when the UV light is irradiated onto the edges of the print regions 16D and 16E that are orthogonal to the x direction, the scanning speed is adjusted to a low speed, as shown in FIG. 8B.

On the other hand, when the UV light is irradiated onto the edge of the print region 16F that is parallel to the x direction, the scanning speed of the UV light is adjusted to a high speed, as shown in FIG. 8B. Although the high speed is set in FIG. 8B at a speed slower than the maximum scanning speed and faster than the speed during low-speed scanning, the high speed may be equal to the maximum scanning speed.

Furthermore, when the UV light is irradiated over the edge of the print section 16F that is parallel to the x direction, the UV light is irradiated with the high speed scanning as mentioned above, and is irradiated a plurality of times by means of a plurality of scanning operations. While the recording paper 16 is conveyed and thereby moves during the plurality of scanning operations, the UV light is irradiated onto the same edge by changing the irradiation direction of the UV light (specifically, changing the turn angle of the scanning mirror 67 on the x direction axis) according to the movement of the recording paper 16.

Consequently, it is possible to irradiate the UV light intensively onto the edge that is parallel to the x direction. Furthermore, even when the UV light is irradiated onto a long edge that is parallel to the x direction, it is possible to prevent the amount of time required to perform one scan in the x direction from becoming long.

In this way, the UV laser scanner capable of performing two-dimensional scanning is able to irradiate UV light efficiently onto the region where the bleeding of the ink would be conspicuous.

At the edges of print regions where the bleeding of the ink would be conspicuous, it is necessary to ensure that the ink that has been deposited on the recording paper is reliably hardened with respect to each dot. The timing at which UV light is intensively irradiated onto ink droplets is described in more detail.

Figure 9A:
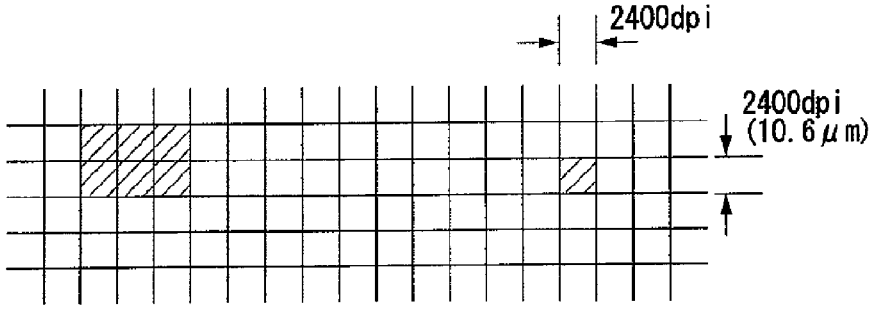
FIGS. 9A, 9B, 9C, and 9D are diagrams for describing the details of the timing at which the scanning speed of the UV light is changed.

FIG. 9A is a diagram showing an arrangement of dots based on image data. In this example shown in FIG. 9A, the dot pitch is 2400 dots per inch (dpi). At 2400 dpi, the interval between the dots is 10.6 μm.

Figure 9B:
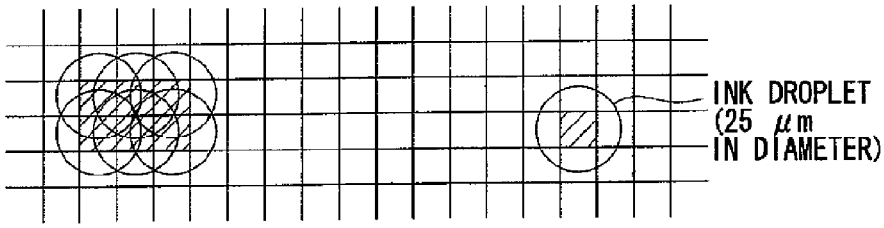

FIG. 9B shows the deposited (ejected) state of the ink droplets corresponding to the dots in FIG. 9A. The diameter of the ink droplet is 25 μm, which is larger than the size of the dot having no interval between them based on the image data, and the ink droplets that are adjacently positioned partially overlap each other.

Figure 9C:
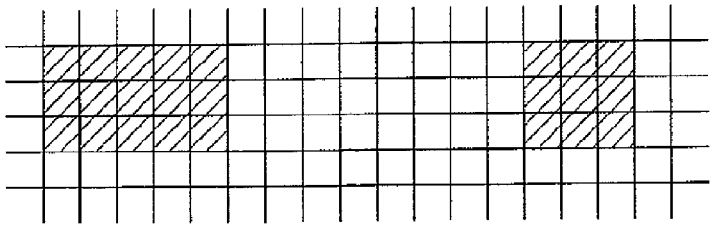

FIG. 9C shows UV light irradiation regions, to which the UV light is irradiated to harden the ink droplets shown in FIG. 9B.

Figure 9D:
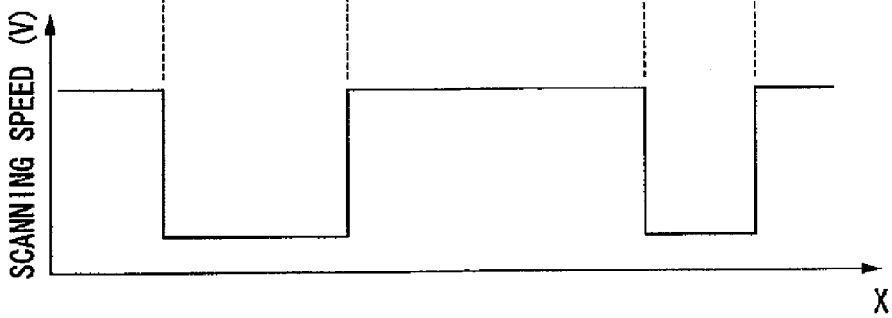

FIG. 9D shows the scanning speed in a case where the UV light is intensively irradiated onto the irradiation regions shown in FIG. 9C.

As shown in FIG. 9D, the scanning speed of the UV light is adjusted to a low speed just before the scan enters the irradiation region, and the scanning speed of the UV light is adjusted to a high speed after the scan leaves the irradiation region. Thereby, it is possible to reliably harden the ink droplets in the edge of the print region.

Although the scanner 60A shown in FIG. 4 has one UV laser light source 61, it is also possible to use a plurality of UV laser light sources in one scanner so as to scan with a plurality of UV light beams. Furthermore, the optical axis of the scanner may be incident on the recording paper perpendicularly or out of perpendicularity. If the optical axis of the scanner is incident perpendicularly on the recording paper, it is possible to obtain a greater luminous energy (and a greater signal) in the case of print determination described hereafter. If the optical axis of the scanner is incident on the recording paper out of perpendicularity, it is preferable that the optical axis is inclined in a direction away from the head in such a manner that the diffuse reflected light reaching the head becomes weaker, so that it is possible to reduce problems caused by ink hardening inside the head.

Next, a print determination method using the scanning optical system of the scanner shown in FIGS. 4, 5A and 5B is described.

As described above, the UV light is irradiated onto the ink droplets ejected and deposited onto the recording paper 16 in order to harden the ink droplets. This UV light is also diffuse-reflected at the focal point on the recording paper 16, and the reflected light passes back through the optical system of the scanner in the opposite direction to the direction of the irradiation.

The semitransparent mirror 64 shown in FIGS. 4, 5A and 5B branches off the reflected light returned through the scanning optical system of the scanner, and causes the reflected light to enter the condenser lens 65. The condenser lens 65 concentrates the incident reflected light on the light receiving surface of the optical sensor 66.

The optical sensor 66 outputs, to the print controller 80, an electrical signal (a measurement signal) corresponding to the luminous energy of the incident reflected light. The reflectivity of the surface of the recording paper 16 is different from the reflectivity of the surface of the ink droplet deposited on the recording paper 16, and then the luminous energy of the reflected light when the UV light is irradiated on the ink droplet is different from the luminous energy of the reflected light when the UV light is not irradiated on the ink droplet. Accordingly, the levels of the measurement signals obtained by the optical sensor 66 differ with respect to the surface of the recording paper 16 and the surface of the ink droplet.

Hence, the print controller 80 is able to determine the presence or the absence of the ink droplet according to the measurement signal obtained from the optical sensor 66. More specifically, the print controller 80 is able to determine the ink droplet ejection and deposition results throughout the entire width direction of the recording paper 16 by taking in the measurement signal from the optical sensor 66 in synchronism with the scanning position of the U light.

The inkjet recording apparatus 10 according to the present embodiment comprises the print determination unit 24 having the line sensor. It is also possible to use the above-described print determination device that uses the scanning optical system of the scanner instead of the print determination unit 24.

Next, an ink ejection determination method using the scanning optical system of the scanner shown in FIGS. 4, 5A and 5B is described.

Figure 10:
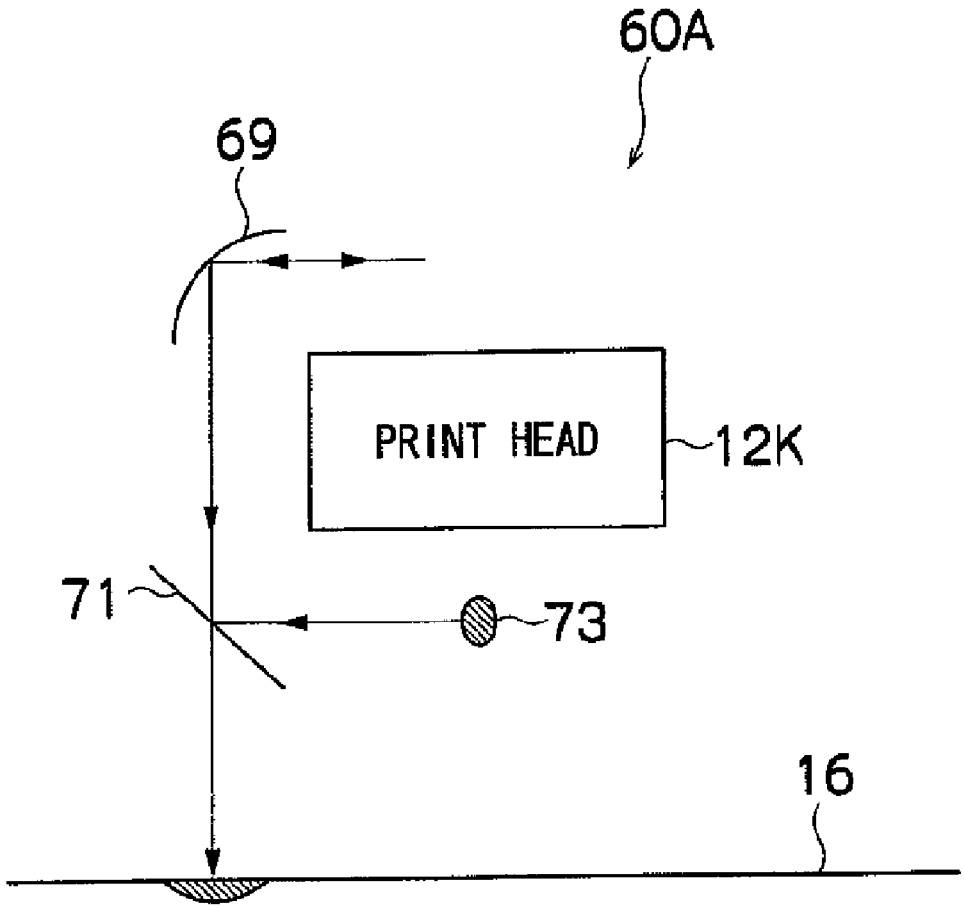
FIG. 10 is a side view of the vicinity of a head in order to describe a method for determining the ink ejection by using the scanning optical system of the UV laser scanner.

FIG. 10 is a side view of the vicinity of the head. In order to achieve this ink ejection determining method, a semitransparent mirror (or a polarizing mirror) 71 is arranged in the light path between the condenser mirror 69 of the scanner 60A and the focal point on the recording paper 16.

The UV light transmitted through the semitransparent mirror 71 is irradiated onto the ink that has been deposited on the recording paper 16, and the UV light reflected by the semitransparent mirror 71 is bent so as to be parallel with the recording paper 16 in such a manner that the UV light is irradiated onto an ink droplet 73 that has been ejected from the head 12K and has not yet been deposited on the recording paper 16.

When the ink is ejected from the nozzle of the head 12K and then the UV light is irradiated onto the ink droplet 73 in flight, the light reflected by the ink droplet 73 returns back in the opposite direction to the irradiation direction via the semitransparent mirror 71 and the optical system of the scanner.

The light, reflected by the ink droplet 73 and returning via the scanning optical system of the scanner, can be measured by the optical sensor 66 in a manner similar to the print determination operation described above. The print controller 80 is thus able to determine whether the ink has been ejected from the nozzle or not with respect to each of the nozzles of the head according to the measurement signal obtained from the optical sensor 66.

According to the above-described ink ejection determination method, it is possible to check for the blockage of the nozzles or the like without printing onto the recording paper.

The present embodiments are described with respect to the inkjet recording apparatus having the line type head, whereas the present invention is not limited to the present embodiments. The present invention may also be applied to an inkjet recording apparatus having a shuttle type head, which reciprocates in a direction orthogonal to the direction of the conveyance of the recording paper.

Figure 11A:
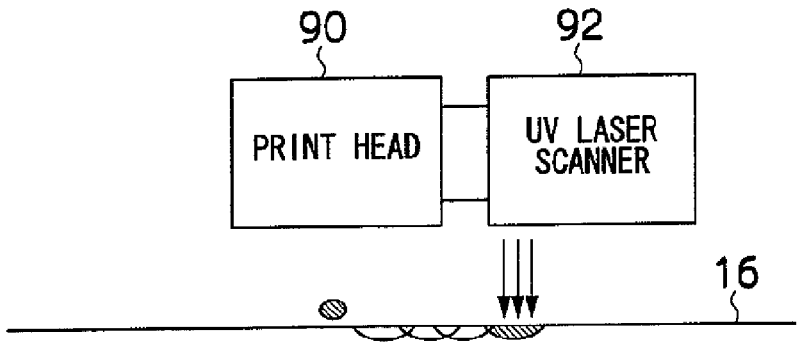
FIGS. 11A, 11B, and 11C are diagrams showing the UV laser scanner installed integrally in a shuttle type head.
Figure 11B:
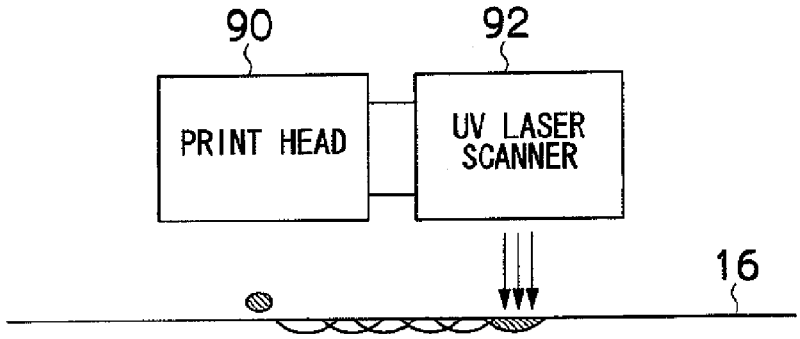
Figure 11C:
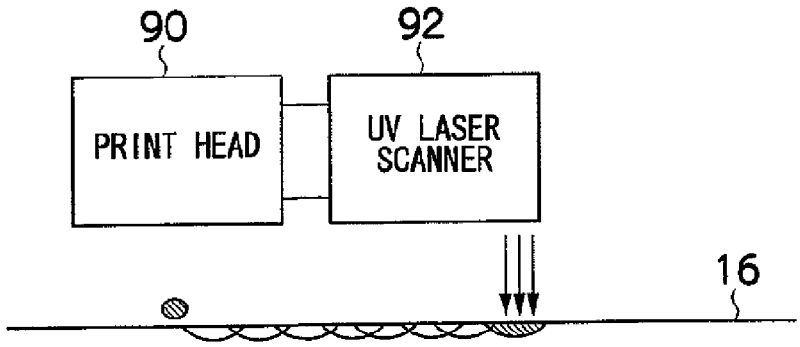

FIGS. 11A, 11B, and 11C show a UV laser scanner 92 integrally arranged in a shuttle type head 90.

The irradiation position of the UV light irradiated by the UV laser scanner 92 moves with the movement of the head 90. When the UV light is to be intensively irradiated onto the edges of the print region where the bleeding of the ink would be conspicuous, then the irradiation position of the UV light emitted from the UV laser scanner 92 is changed according to the movement of the head 90, as shown in FIGS. 11A, 11B and 11C, and the movement of the irradiation position of the UV light is halted at the edge of the print region and/or the movement speed (the scanning speed) of the irradiation position is reduced at the edge of the print region. The UV laser scanner 92 may have a similar composition to that illustrated in FIG. 4. Furthermore, if there are a plurality of nozzles in the shuttle type head 90, then the UV laser scanner 92 is configured to two-dimensionally scan the ejection positions of the nozzles with the UV light.

The above-mentioned embodiments are described with respect to a case where the inks are the UV curable inks hardened by irradiating UV light onto the UV curable ink, whereas the present invention is not limited to this. In the case of using another radiation-curable or light-curable ink that is hardened by another type of radiation (e.g., infrared light, visible light, or other types of radiation) other than the UV light, it is necessary to irradiate the type of radiation that can harden that ink.

Moreover, the regions where the ink bleeding would be conspicuous are not limited to the edges of the solid print region 16A, the edges of the line region 16B, and the isolated dot 16C. A region of high contrast or a region of large color variation may also correspond to the region where ink bleeding would be conspicuous.

The region of high contrast or the region of large color variation here is determined as follows, for example. The image to be printed is expressed as two-dimensional data by means of a standard color representation method, which uses RGB data, CMYK data, L*a*b* data, or the like. The two-dimensional data is then filtered by multiplying the two-dimensional data by an edge detection matrix such as the Prewitt matrix, the Sobel matrix and the Roberts matrix. Regions corresponding to higher values out of values based on the filtering operation results are the edge region, and are the regions of the high contrast or the large color variation.

If emphasis is particularly placed on the contrast, then the L* data are preferably used. If emphasis is particularly placed on the color, then a*b* data are preferably used. The method is not limited to this, and the data based on any type of color representation methods may be used.

Instead of using the matrix for the edge detection, it is also possible to derive the absolute values for the concentration difference and the color difference between adjacent pixels and to determine regions corresponding to the large absolute values as regions of the high contrast or the large color variation. For example, the absolute value of difference between the L* data for two points can be used as the concentration difference between the two points. The square root of the sum of the squares of the differences between the a*b* data for two points can be used as the color difference between the two points.

The deposited ink corresponding to the following first pixels or second pixels is actually subjected to the intensive irradiation of the light. The first pixels are within the edge regions and moreover have image concentration (such as the L* value) more than a predetermined threshold value derived from a predetermined bleeding potential estimated from the combination of the ink characteristics and the recording medium characteristics. The second pixels are adjacent to the first pixels. For instance, the first pixels correspond to the portions whose L* values are greater than the predetermined threshold value, above which the bleeding of the ink is liable to occur, derived from the bleeding potential determined on the basis of the properties of the ink and the recording medium.

More specifically, the aforementioned filtering process is carried out with respect to pixels in the range in which light can be irradiated onto the deposited ink in one scanning operation, the filtered values for the pixels are respectively determined, and a histogram of the filtered values is made.

Using this histogram, the relevant pixels are taken to be those pixels which have the higher filtered values and have the image concentration greater than the threshold value, above which the bleeding is liable to occur, derived from the bleeding potential determined on the basis of the properties of the ink and the recording medium. The relevant pixels are established starting from the pixel having the highest maximum filtered value and continuing until the number of pixels that can be irradiated in one scan is reached. Light is then intensively irradiated onto the deposited ink in the region of these pixels (the first pixels) and the adjacent pixels (the second pixels).

Moreover, as a simpler alternative, it is also possible to adopt a method in which the filtered values for the pixels are determined by carrying out the aforementioned filtering process with respect to the pixels in the range in which light can be irradiated onto the deposited ink in one scan, whereupon a histogram of these filtered values is made. Then, using this histogram, the light is intensively irradiated onto the deposited ink in the region of the pixels (the first pixels) having higher filtered values, starting from the highest filtered value of the respective pixels and continuing until the number of pixels that can be irradiated in one scan is reached, and in the region of the second pixels adjacent to the first pixels.

The definitions of L*a*b* are as described below by way of example.

Japanese Standards Association: Japanese Industrial Standards Handbook "Optics"

Color representation methods: L*a*b* representation scheme and L*u*v* representation scheme Standard number: JIS Z8729: 1994

FIGS. 12A, 12B and 12C show the Prewitt matrix, the Sobel matrix and the Roberts matrix, respectively. The rotated matrices are obtained by rotating the matrices shown in FIGS. 12A, 12B and 12C through 90°. Edges in the longitudinal direction and in the width direction are determined by means of the matrices shown in FIGS. 12A, 12B and 12C and the rotated matrices.

The actual calculation is similar to a standard image processing matrix calculation. It is possible to adopt the filtered value obtained from the following calculation. An absolute value may be determined for the sum of the products of "the target pixel and the peripheral pixels around the target pixel" and the corresponding components of the matrix being adopted. Then, the larger of calculation results concerning the longitudinal direction and the width direction may be taken as the filtered value for the target pixel.

It should be understood, however, that there is no intention to limit the invention to the specific forms disclosed, but on the contrary, the invention is to cover all modifications, alternate constructions and equivalents falling within the spirit and scope of the invention as expressed in the appended claims.

The invention claimed is:

1. An inkjet recording apparatus, comprising:

a head which ejects ink droplets of light-curable ink to a print medium to form an image on the print medium;

a light irradiating device which is located at a downstream side of the head, and irradiates light from a light source onto the ink droplets immediately after the ink droplets have been deposited on the print medium, wherein the light irradiating device includes a scanning device, including:

the light source which emits the light, an optical system including a scanning mirror, the optical system concentrating the light emitted by the light source onto the print medium through the scanning mirror, and a mirror turning device which turns the scanning mirror;

a control device which controls the light irradiating device in such a manner that luminous energy irradiated onto a region of the print medium where bleeding of the ink droplets would be conspicuous is greater than luminous energy irradiated onto another region of the print medium; and an ink ejection determination device, including:

a first branching device which is disposed in an optical path of the optical system, and causes the light to branch off in such a manner that the light passes through a gap between the head and the print medium, thereby irradiating the light onto the ink droplets which have been ejected from the head and have not yet been deposited on the print medium, a second branching device which is disposed in the optical path between the light source and the scanning mirror, and causes reflected light reflected by the ink droplets which have not yet been deposited on the print medium and returned back through the optical system to branch off, an optical sensor which measures the reflected light branched off by the second branching device and outputs a measurement signal, and a judging device which judges whether the ink droplets have been ejected from nozzles of the head or not according to the measurement signal obtained from the optical sensor.

2. The inkjet recording apparatus according to claim 1, wherein the first branching device causes the light to branch off into a first branching light and a second branching light, the first branching light irradiating an ink that has been ejected from the head and has not yet landed on the print medium and the second branching light irradiating an ink that has landed on the print medium.

3. The inkjet recording apparatus according to claim 1, wherein the first branching device causes the light to branch off in parallel to the print medium so as to irradiate an ink that has been ejected from the head and has not yet landed on the print medium.

4. The inkjet recording apparatus according to claim 1, wherein the first branching device and the second branching device are semitransparent mirrors.

5. The inkjet recording apparatus according to claim 1, wherein the region of the print medium where the bleeding of the ink droplets would be conspicuous is at least one of an edge of a solid print region in the image, an edge of a line region in the image, an isolated dot in the image, a region of high contrast in the image, and a region of large color variation in the image.

6. The inkjet recording apparatus according to claim 1, wherein the light irradiating device includes the scanning device which scans the print medium in a width direction of the print medium with the light having a prescribed beam width; and the control device also controls the light irradiating device to irradiate constant luminous energy, and controls the scanning device in such a manner that a scanning speed with respect to the region of the print medium where the bleeding of the ink would be conspicuous is slower than a scanning speed with respect to the other region of the print medium.

7. The inkjet recording apparatus according to claim 1, wherein the light irradiating device includes a scanning device which two-dimensionally scans the print medium in a width direction and a conveyance direction of the print medium with the light having a prescribed beam width; and the control device controls the light irradiating device to irradiate constant luminous energy, and controls the scanning device in such a manner that a scanning speed with respect to the region of the print medium where the bleeding of the ink would be conspicuous is slower than a scanning speed with respect to the other region of the print medium.

8. The inkjet recording apparatus according to claim 1, wherein the light irradiating device includes the scanning device which two-dimensionally scans the print medium in a width direction and a conveyance direction of the print medium with the light having a prescribed beam width; and the control device also controls the light irradiating device to irradiate constant luminous energy, and controls the scanning device in such a manner that the region of the print medium where the bleeding of the ink would be conspicuous is scanned a plurality of times.

9. The inkjet recording apparatus according to claim 1, wherein the light irradiating device includes the scanning device which scans the print medium in a width direction of the print medium with the light having a prescribed beam width; and the control device controls a scanning speed of the scanning device to be constant, and controls the light source of the light irradiating device in such a manner that the luminous energy irradiated onto the region of the print medium where the bleeding of the ink would be conspicuous is increased.

10. The inkjet recording apparatus according to claim 1, wherein the light irradiating device includes the scanning device having: the light source which emits the light; an optical system including the scanning mirror, the optical system concentrating the light emitted by the light source onto the print medium through the scanning mirror; and a mirror driving device which drives the scanning mirror.

11. The inkjet recording apparatus according to claim 1, wherein the head is a line type head having a length corresponding to a maximum width of the print medium; and the light irradiating device comprises a plurality of the scanning devices arranged in a longitudinal direction of the line type head.

* * * * *